US007530731B2

(12) United States Patent
Toncelli

(10) Patent No.: US 7,530,731 B2
(45) Date of Patent: May 12, 2009

(54) VERTICAL-AXIS MIXING MACHINE FOR PROCESSING MIXES

(76) Inventor: Dario Toncelli, Via San Pancrazio 3, Bassano Del Grappa (IT) 36061

( * ) Notice: Subject to any disclaimer, the term of this patent is extended or adjusted under 35 U.S.C. 154(b) by 110 days.

(21) Appl. No.: 11/782,086

(22) Filed: Jul. 24, 2007

(65) Prior Publication Data

US 2008/0181049 A1 Jul. 31, 2008

Related U.S. Application Data

(63) Continuation of application No. PCT/EP2006/050463, filed on Jan. 26, 2006.

(51) Int. Cl.
*B01F 7/30* (2006.01)

(52) U.S. Cl. ..... 366/167.2; 366/288

(58) Field of Classification Search ..... 366/40, 366/64, 65, 167.2, 170.3, 287, 288
See application file for complete search history.

(56) References Cited

U.S. PATENT DOCUMENTS

| | | | | |
|---|---|---|---|---|
| 442,081 | A * | 12/1890 | Nelson | 366/170.3 |
| 3,456,926 | A | 7/1969 | Hummelshoj | |
| 4,165,185 | A * | 8/1979 | Fejmert | 366/65 |
| 4,453,831 | A | 6/1984 | Mahon | |
| 5,890,803 | A * | 4/1999 | Jolink | 366/170.3 |

FOREIGN PATENT DOCUMENTS

| | | |
|---|---|---|
| DE | 31 13 141 | 4/1982 |
| DE | 94 19 488 | 4/1996 |
| FR | 2 432 925 | 3/1980 |
| GB | 838153 | 6/1960 |
| GB | 2 153 696 | 8/1985 |

OTHER PUBLICATIONS

International Search Report and Written Opinion of ISA, dated Jun. 7, 2006, from corresponding International Patent Application No. PCT/EP2006/050463.

* cited by examiner

*Primary Examiner*—David L Sorkin
(74) *Attorney, Agent, or Firm*—Katten Muchin Rosenman LLP

(57) ABSTRACT

Mixing machine of the type comprising a container (10), inside which aggregates and binding fluids are introduced in order to form stone mixes, and at least one motor-driven mixing unit (30; 130A, 130B), the axis (Y; Y1, Y2) of which is parallel to and at a distance from the central axis (X) of the container (10). In order to introduce the binding fluids into the container (10), the machine comprises a dispensing unit (50; 150) which rotates in synchronism with the mixing unit (30; 130A, 130B), remaining always angularly at a distance therefrom.

13 Claims, 4 Drawing Sheets

VERTICAL-AXIS MIXING MACHINE FOR PROCESSING MIXES

The present invention relates to a mixing machine of the type used for processing mixes containing one or more ingredients with abrasive properties, in particular stone agglomerates consisting of hard stones such as quartz bonded with binding fluids such as inorganic resins or with hydraulic binders.

In recent years there has been an increasingly widespread use of technologies for the production of stone agglomerates, in particular in the form of sheets useful for floors and wall linings, both inside and outside. These technologies are fully described in numerous patents, for example U.S. Pat. Nos. A-4,204,820 and 5,264,168, EP-A-0,378,275 and GB-A-2, 098,126.

These agglomerates are produced from mixes, the main ingredients of which consist of an aggregate formed by calibrated granules of a natural stone material or stone-like or ceramic material, and an inorganic binder (for example a cement binder) or organic binder (for example a synthetic hardening resin). Other ingredients may be present in each case, in smaller quantities, for example colouring agents.

The mixes are prepared in so-called mixing machines, which essentially consist of a container—preferably cylindrical—inside which there is mounted at least one mixing unit comprising a certain number of rotating blades which are actuated by a motor via a speed reducer and which thoroughly mix the various ingredients loaded into the container. Said machines may be classified in two main categories, namely horizontal-axis machines and vertical-axis machines, where the axis in question is the axis of rotation of the at least one mixing unit, which usually coincides with or is parallel with, and situated at a distance from, the central axis of the container.

The present invention relates to vertical-axis machines with at least one mixing unit which is axially offset with respect to the container, the various ingredients being loaded inside it from above and being discharged through an opening in the bottom of the cylindrical container which can be closed by a shutter, while the binding fluids are discharged via one or more pipes fixed along the side walls of the container so as not to contaminate the reducer.

Also because of their considerable size (the diameter of the container is generally between 1.2 and 3 m and the height between 2 and 3 m) and the rated power (in turn ranging between 11 and 55 kW), the present-day mixers require a huge financial outlay, but do not operate with the level of effectiveness and efficiency desirable for the users thereof.

The vertical-axis mixers known hitherto are penalized by the fact that the distribution of the binding fluids inside the mix is not uniform since it is with difficulty that the blades of the mixing unit manage to convey the binding fluids towards the central zone of the container. Moreover, when they flow along the walls, the binding fluids collect dust and form encrustations which with time tend to harden.

During the course of the subsequent mixing cycles, the partially hardened encrustations are detached from the side walls and from the bottom of the container by the abrasive action of the aggregates and cause contamination of the mix, with a consequent deterioration in the appearance of the finished product. The contamination by dark-coloured particles in fact makes it difficult, if not impossible, to achieve mixing of light-coloured mixes with the chromatic purity needed to give the agglomerated material that sophisticated aesthetic finish which is nowadays required by an increasingly demanding market.

Moreover, the mixing machines known hitherto are penalized by the frequent operations required both for maintenance, in order to repair the internal surfaces of the container which have been subject to the intense abrasive action of the very hard aggregates, such as quartz, present in the mixes, and for cleaning, in order to eliminate the encrustations and reduce to a minimum the abovementioned chromatic contamination of the mixes.

The cleaning operations, which involve removal of the residue left on the side walls and the bottom of the container, are normally performed in a totally manual manner, requiring long machine downtimes, so that they are very costly as well as being difficult to perform. It is obvious that the more frequent these operations the lower the productivity of the mixing machines.

In the case of vertical-axis mixing machines attempts have been made to remedy partially the problem of contamination of the mixes, due to encrustations or rapid wear, by lining the walls of the container with a plurality of modular elements which are made for example of chrome-plated steel or steel lined with white-coloured/transparent plastic material and which are fixed in the desired position by means of fast-fitting systems. The worn modular elements to be renewed may be disassembled and replaced with identical elements which have already been repaired, obviously with the production line stopped. While there is an undoubted reduction in the duration of the corresponding machine downtime, this solution is penalized by the increase in the fixed costs since the user companies must have at least two complete series of the said modular elements at their disposal.

As for the blades, in order to increase their working life (and consequently reduce the frequency of the maintenance operations) it is customary to line them with a sheath of plastic material to be replaced daily or, on the other hand, line them with a layer of very hard and strong sintered alumina.

The main object of the present invention is to improve the efficiency of dispersion of the binding fluid within the mix.

Another object is to reduce to a minimum the contamination caused by hard encrustations of binding fluid and the chromatic contamination of the mixes by particles detached as a result of abrasion from the side walls and the bottom, from the blades and from other internal components of the vertical-axis mixers.

A further object of the present invention is to increase the productive efficiency of the vertical-axis mixers without varying the rated power or the dimensions, but reducing significantly the frequency and/or the duration of the downtime for maintenance or cleaning operations.

In order to achieve these and other objects the present invention consists of a mixing machine, the constructional features of which are defined in the following claims.

Characteristic features and advantages of the present invention will be clarified by the detailed description which follows of a preferred, but not sole embodiment, with reference to the accompanying drawings in which.

Figure 1:
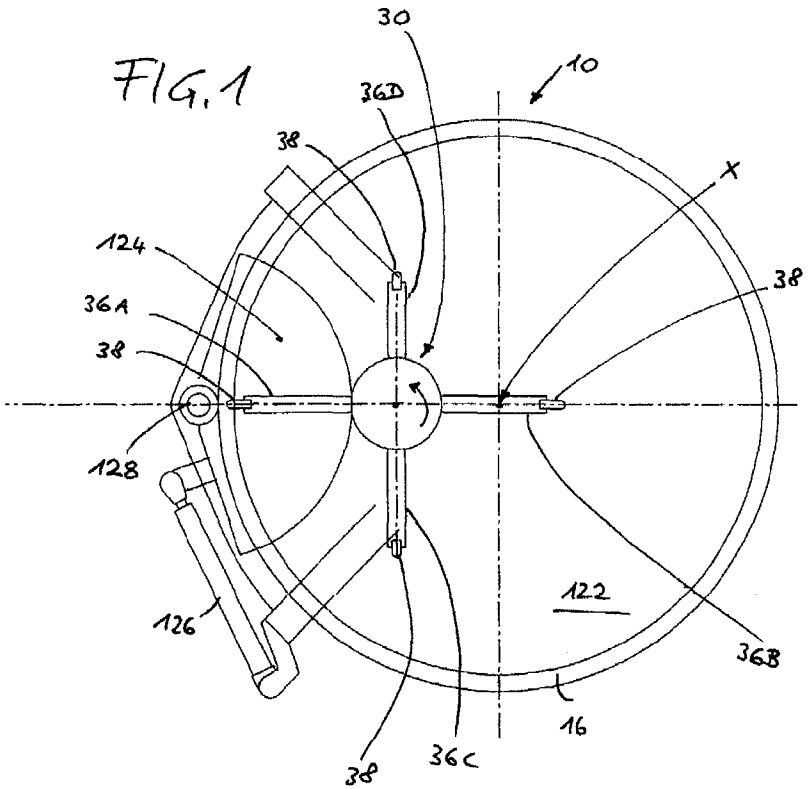
FIG. 1 is a simplified view, from above, of a vertical-axis mixing machine with a single mixing unit according to the state of the art.
Figure 2:
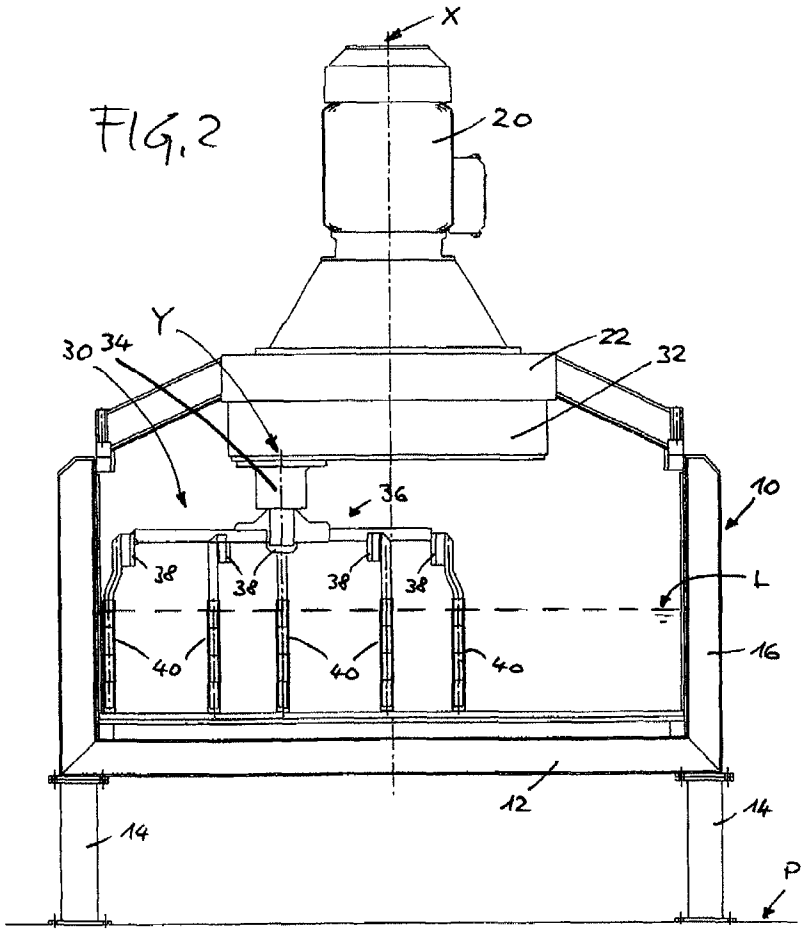
FIG. 2 shows the machine according to FIG. 1 in greater detail along a sectional plane passing along the vertical axis of the blade actuating motor.

With reference firstly to FIGS. 1 and 2, a conventional mixing machine for processing mixes containing one or more ingredients with abrasive properties, in particular stone agglomerates consisting of hard stone such as quartz, comprises a cylindrical container denoted overall by the reference number 10 and a motor 20 for actuating, by means of a reduction gear 32, a mixing unit 30. As is known, it is inside the container 10 that the mixes which form the raw material of the agglomerates mentioned at the start of the present description are produced. In FIG. 2 the broken line denoted by L indicates the maximum height which the mixes being processed are able to reach inside the container 10 of the mixing machine.

By means of a rigid framework 22 the motor 20 is mounted on top of container 10 and has its vertical axis X coinciding therewith.

The container 10 comprises, in turn, a bottom wall 12 provided with feet 14 for resting on the ground P and a side wall 16. In a manner known per se, the bottom wall 12 is divided into a fixed part 122 and a movable part or shutter 124, in the form of a circle segment—see FIG. 1. Said shutter is movable, by means of an actuating cylinder 126 and a vertical pin 128, between a closed position (which is shown in FIG. 1) and an open position in which the aperture for discharging the mix at the end of the mixing step is uncovered.

The cylindrical container 10 has, operating inside it, the mixing unit 30 which comprises first and foremost the reduction gear 32 rotating about its own input shaft, the axis X of which is the same as that of the container 10 and the motor 20 and the output shaft of which has its axis Y parallel to but at a distance from the axis X—see in particular FIG. 2. Therefore, said output shaft of the reduction gear 32, in addition to rotating about itself, i.e. about the axis Y, rotates about the axis X.

Figure 4:
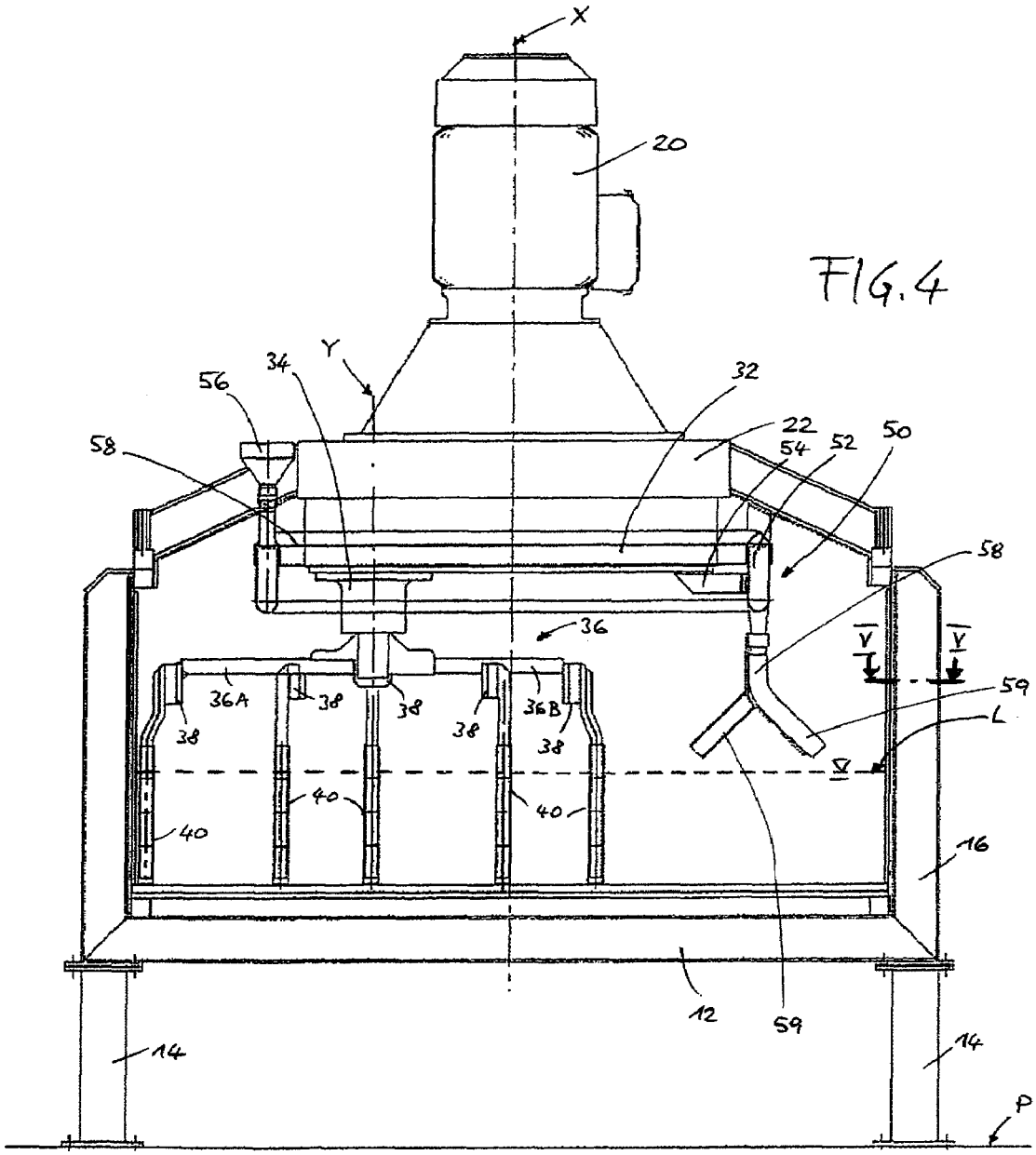
FIG. 4 is similar to FIG. 2, but shows the machine according to FIG. 3.

A planet wheel 34 is rotatably fixed to the output shaft of the eccentric reducer 32 and has a cross-piece 36 from which arms 36A, 36B, 36C, 36D extend towards the bottom of the hubs 38. As shown in FIGS. 2 and 4, the two diametrically opposite arms 36A and 36B, which are longer, support a hub 38 at the free end and a hub in the middle, while the other two diametrically opposite arms 36C and 36D, which are shorter, support only one hub 38 at the free end. The end of a mixing blade 40 is rigidly fixed to each of the hubs 38.

From this description it is clear that the blades 40 are arranged vertically inside the container 10, so as to be constantly immersed within the processing mixes, terminating at a minimum distance from the bottom wall 12. The surface of the bottom wall 12 is therefore fully swept by all the blades 40 when the motor 20 is operating since they rotate about the axis Y of the planet wheel 34 (see arrow F1 in FIG. 1) and, in turn, the planet wheel rotates about the axis X of the container 10 and the motor 20 (see arrow F2 of the same Figure).

Figure 3:
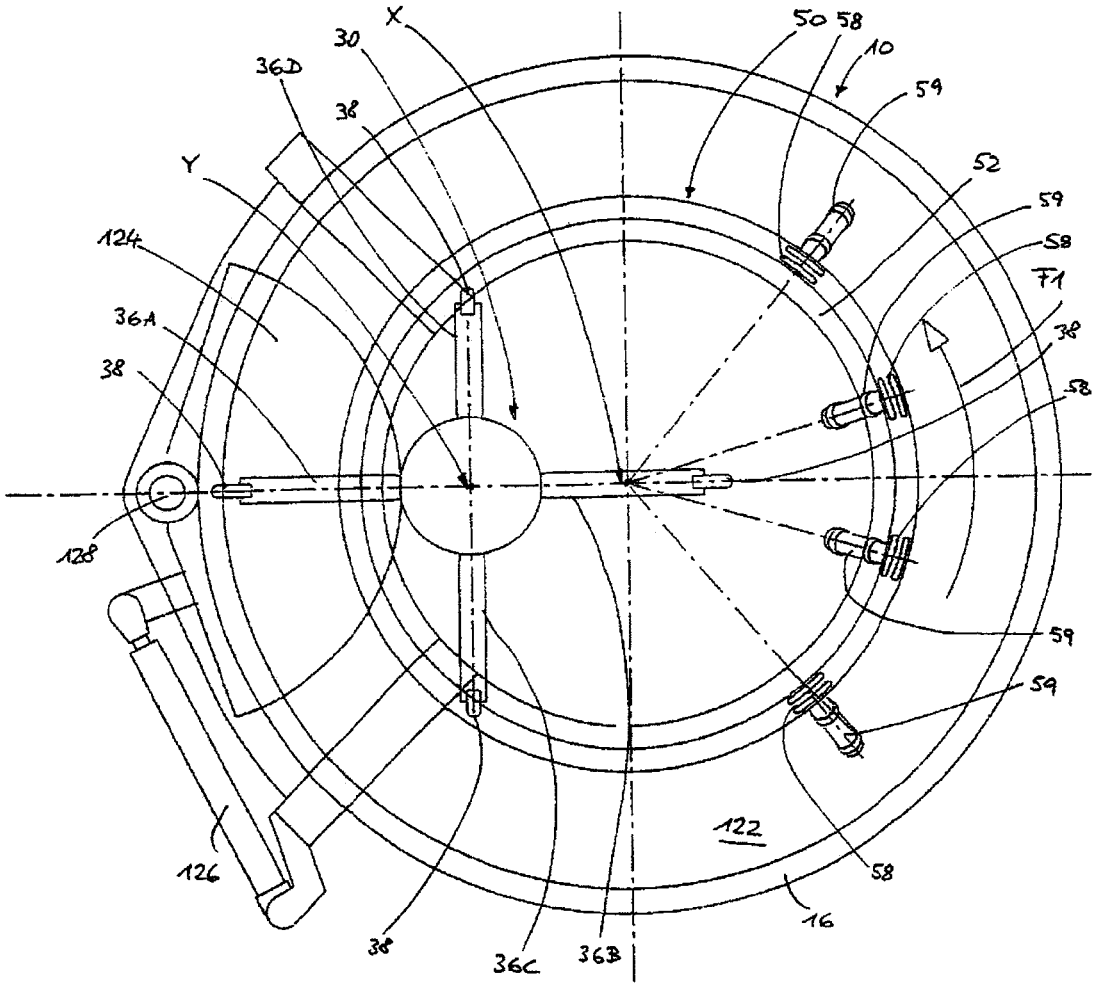
FIG. 3 is similar to FIG. 1, but shows a vertical-axis mixing machine with a single mixing unit according to the invention.

With reference now to FIGS. 3 and 4 (where a first embodiment of the present invention is shown and where parts common to the known machine are not described again and keep the same reference numbers as in FIGS. 1 and 2) a rotating unit dispensing the binding fluid forming part of the mix being processed also operates inside the cylindrical container 10, said unit being denoted overall by the reference number 50. The dispensing unit 50 comprises an annular-shaped channel 52 which has an annular lid 57 with a vertical pipe 56 for entry of the binding fluid and supports a plurality of outlet pipes 58.

The channel 52 is connected to the reduction gear 32 by means of a rigid arm 54 so as to rotate about the axis X of the container 10 and the motor 20 in synchronism with the planet wheel 34, but remaining in a position diametrically opposite to the said planet wheel, as indicated by the arrow F2 in FIG. 3.

The end section 59 of the outlet pipes 58, although directable, is at a suitable distance from the internal surface of the side wall 16 of the container 10 and is moreover situated at a lower level than the eccentric reduction gear 32 and at a higher level than the maximum height L of the mixes being processed—see FIG. 4.

Dispensing of the binding fluid inside the container 10 therefore occurs in synchronism with rotation of the mixing unit 30 about the axis X, but in a position diametrically opposite to the said mixing unit 30 so as to ensure optimum mixing of the binding fluid with the aggregate and so as not to contaminate either the side wall 16 of the container nor the eccentric reduction gear 32 nor the planet wheel 34 nor the blades 40. Both the formation of encrustations and the need to stop operation of the machine in order to perform the cleaning operations are thus drastically reduced.

It can be easily understood how these smaller and/or less frequent cleaning operations, due to the lesser degree of contamination, help considerably increase the productivity of the present mixing machine.

Figure 5:
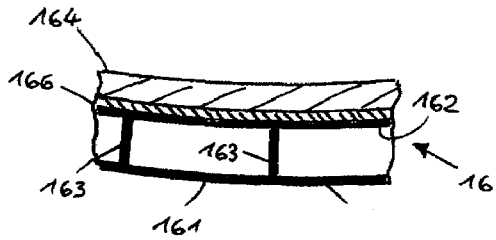
FIG. 5 is a cross-section, on a larger scale, along the line V-V of FIG. 4, of the side wall of the cylindrical container forming part of the machine.

As shown in FIG. 5, the side wall 16 of the container 10 comprises an outer shell 161 and an inner shell 162 joined together by radial ribs 163. These parts are made of metal, for example steel.

The inner shell 162 is lined internally with curved sheets 164 which are manufactured using a mix consisting of granulated stone material having a hardness factor equal to or greater than 7 Mohs and resins able to be hardened by means of crosslinking with a very small degree of shrinkage. Preferably, the stone materials are chosen from among quartz, corundum and alumina and the hardening resins are epoxy resins. If necessary, the sheets 164 are internally reinforced with reinforcing elements such as a metal mesh, for example steel mesh, or a glass fibre mesh or mat impregnated with epoxy resin, so as to increase the impact strength thereof (for example in accordance with the teachings of the patent U.S. Pat. No. 5,670,007).

A method for producing the sheets 164, as well as other articles with a shape which is not flat, form the subject of a patent application filed on the same date by the same Applicant.

In the embodiment described and illustrated here the sheets 164 are fixed by means of bonding, for example using silicone adhesive, to steel panels 166 provided with stud bolts (not shown) which are butt-welded thereon and which allow them to be mechanically fixed to the metal shell 162 in an easily and rapidly removable manner. Alternatively, the sheets 164 may be fixed by means of bonding, for example using silicone adhesive, directly to the metal shell 162.

It has been shown in tests that the use of the sheets 164 (which have a very long working life of about 6-8 months of two working shifts) produces the following advantages:

- it prevents the release of metal particles from the inner shell 162 of the side wall 16 of the container 10, the colour of the mix being processed not being contaminated;
- the frequency of the maintenance operations carried out on the said container 10 is reduced and cleaning of the side wall 16 whenever the mix is changed or at the end of the production cycle is much easier.

In a similar manner, the entire bottom wall 12 has a removable protective coating which prevents the separation of dark contaminating particles.

In short, owing to the use of the sheets 164 on the side wall 16 and the similar sheets on the bottom wall 12 (namely on structural parts in contact with the mix being processed), the productive efficiency of the mixing machine is increased.

Figure 6:
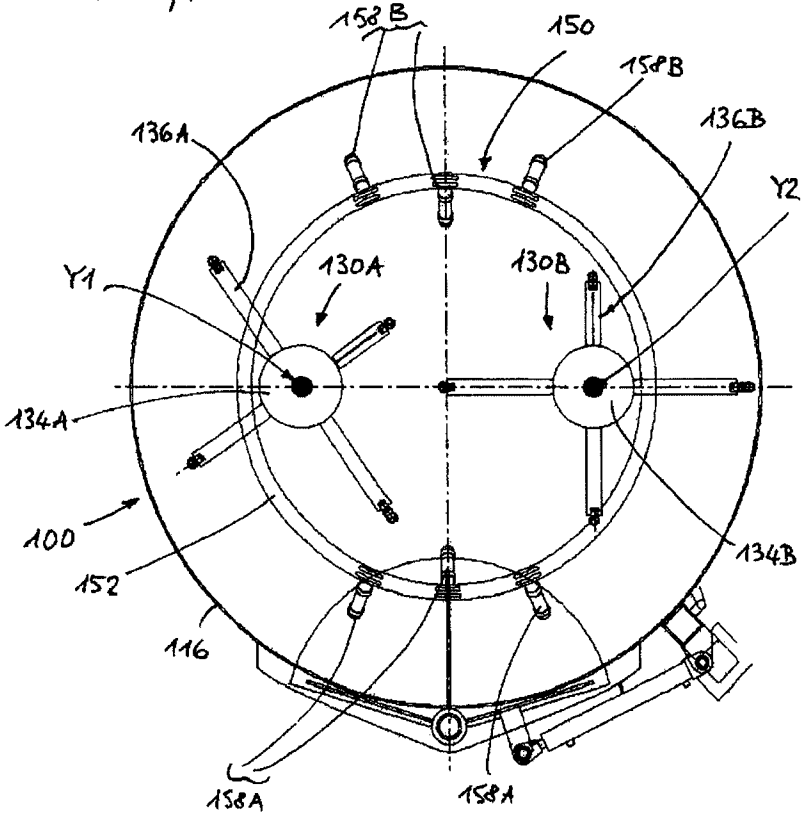
FIG. 6 is similar to FIGS. 1 and 3, but shows a vertical-axis mixing machine with two mixing units according to the invention.
Figure 7:
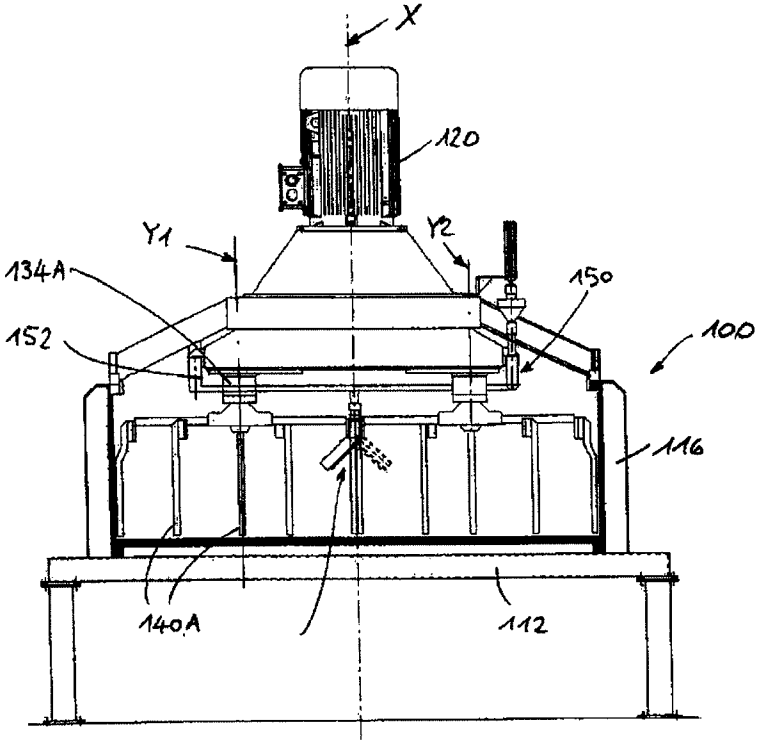
FIG. 7 is similar to FIGS. 2 and 4, but shows the machine according to FIG. 6.

FIGS. 6 and 7 refer to a second embodiment of the invention. The mixing machine shown differs from those of the preceding figures in that it comprises a container 100 with larger dimensions and two mixing units 130A, 130B actuated by a single motor 120, having the same axis X as the container, via a reduction gear 132. The output shaft of the reduction gear has, rotatably fixed thereto, two planet wheels 134A and 134B, the axes Y1 and Y2 of which are parallel to the axis X of the container 100 and the motor 120 and offset by 180° with respect to each other. The planet wheels 134A and 134B have cross-pieces 136A, 136B to which the vertical mixing blades 140A, 140B are fixed, respectively, the latter therefore rotating about the axes Y1 and Y2 of the planet wheels (see arrows F3 and F4 in FIG. 6) and simultaneously rotating, together with the said planet wheels 134A and 134B, about the axis X of the container 100 and the motor 120 (see arrow F5 in the same Figure).

These parts of the machine, as well as the linings of the inner surfaces of the side wall 116 and the bottom wall 112 of the container 100, are not described further since they are substantially identical to those of the machine shown in FIGS. 3-5. It should be noted only in FIG. 6 that the trajectory of the blades 140A of the first cross-piece 136A interferes partially with the trajectory of the blades 140B of the second cross-piece 136B so as to optimize mixing of the mix.

In a similar manner to the first embodiment shown in FIGS. 3-5, the mixing machine according to FIGS. 6 and 7 has a rotating unit 150 for dispensing the binding fluid which forms part of the mix being processed. Said rotating dispensing unit 150 comprises, in addition to parts substantially identical to those already described (which are therefore not described again), an annular channel 152 connected to the reducer 132 so as to rotate about the axis X of the container 100 and the motor 120 in synchronism with the planet wheels 134A and 134B (see arrow F5 in FIG. 6) and two sets of outlet pipes 158A, 158B for the binding fluid. The two sets of outlet pipes 158A, 158B for the binding fluid are offset at 180° with respect to each other and at 90° with respect to the two mixing units 130A, 130B.

In this embodiment also the directable end section 159 of the outlet pipes 158 is situated at a lower level than the eccentric reducer 132 and at a higher level than the maximum height of the mixes being processed inside the container 100.

Dispensing of the binding fluid therefore occurs in synchronism with the rotation of the two mixing units 130A, 130B about the axis X of the container 100 and the motor 120, but in a position angularly spaced by 90° with respect to the two mixing units 130A, 130B so as to ensure optimum distribution of the binding fluid with the aggregate and so as not to contaminate either the side wall 11 nor the reducer 132 nor the planet wheels 134A, 134B nor the blades 140A, 140B.

The advantages of this second embodiment of the invention are the same as those mentioned for the first embodiment.

Other variants and embodiments of the present mixing machine may be envisaged within the scope of the following claims.

The invention claimed is:

1. Mixing machine comprising:

a container (10; 100) with a vertical axis of symmetry (X) inside which aggregates and binding fluids are introduced in order to form stone mixes;

and at least one mixing unit (30; 130A, 130B) actuated by a motor (20; 120) so as to rotate about said axis (X) of symmetry of the container (10; 100);

at least one blade (40; 140A, 140B) which forms part of said at least one mixing unit (30; 130A, 130B) and which acts on the mixes being processed and in turn rotates about an axis (Y; Y1, Y2) parallel to and at a distance from said axis (X) of symmetry of the container (10; 100);

characterized in that it also comprises at least one unit for dispensing said binding fluids inside the container (10; 100) which rotates about said axis (X) of symmetry of the container (10; 100) in synchronism with said at least one mixing unit (30; 130A, 130B), remaining constantly in a position angularly spaced from said at least one mixing unit.

2. Mixing machine according to claim 1, characterized in that said unit (50) for dispensing said binding fluids comprises a rotating annular channel (52), at least one fixed inlet pipe (56) and at least one outlet pipe (58) which is integral with said rotating channel (52) and the outlet (59) of which is positioned so that dispensing of the binding fluids occurs always in a substantially vertical direction and in a position diametrically opposite to that of the single mixing unit (30).

3. Mixing machine according to claim 2, characterized in that the outlet (59) of said at least one outlet pipe (58; 158A, 158B) for the binding fluids from said rotating annular channel (52; 152) is situated at a distance from the side wall (16; 116) of said container (10; 100).

4. Mixing machine according to claim 2, in which said at least one mixing unit (30; 130A, 130B) also comprises a reduction gear (32; 132), the input shaft of which has its axis (X) coinciding with that of said actuating motor (20; 120) and said container (10; 100) and the output shaft of which has its axis (Y) parallel to, but at a distance from the axis (X) of the input shaft and is rotatably fixed to at least one planet wheel (34; 134A, 134B) to which said at least one mixing blade (40; 140A, 140B) is integrally joined, characterized in that said annular channel (52; 152) is rigidly connected to said reduction gear (32, 132) so as to rotate about said axis (X) coinciding with that of said actuating motor (20; 120), the input shaft of said reduction gear (32; 132) and said container (10; 100), thus keeping said at least one outlet pipe (58; 158A, 158B) for the binding fluids constantly in a diametrically opposite position at a distance from the axis Y; Y1, Y2) of said at least one planet wheel (34; 134A, 134B).

5. Mixing machine according to claim 4, characterized in that the outlet (59) of said at least one outlet pipe (58; 158A, 158B) for the binding fluids from said rotating annular channel (52; 152) is also situated at a lower level than said reducer (32; 132) and at a higher level than the maximum height (L) of the mixes being processed inside said container (10; 100).

6. Mixing machine according to claim 1, characterized in that said unit (150) for dispensing said binding fluids comprises a rotating annular channel (152), at least one fixed inlet pipe and two or more sets (158A, 158B) of outlet pipes which are integral with said rotating channel (152) and the outlet (152) of which is positioned so that dispensing of the binding fluids occurs always in a substantially vertical direction and in a position angularly spaced from that of the at least one mixing unit (130A, 130B).

7. Mixing machine according to claim 1, characterized in that said binding fluids introduced inside said container (10) by said dispensing unit (50) are organic resins of the hardening type.

8. Mixing machine according to claim 1, in which said container (10; 100) comprises a bottom wall (12; 112) and a side wall (16; 116), characterized in that the inner surface (162) of said side wall (16; 116) is lined with an abrasion-resistant and colourless material obtained from a mix consisting of granulated stone materials having a hardness factor equal to or greater than 7 Mohs and resins able to be hardened by means of crosslinking with a very small degree of shrinkage.

9. Mixing machine according to claim 8, characterized in that, in order to form said lining, the stone materials are chosen from among quartz, corundum and alumina and the hardening resins are epoxy resins.

10. Mixing machine according to claim 8, characterized in that said lining is formed with a plurality of sheets (164) having a curved shape.

11. Mixing machine according to claim 8, characterized in that said sheets (164) are fixed by means of bonding, for example using silicone adhesive, to steel panels (166) which are designed to be removably fixed to the internal surface (162) of the side wall (16; 116) of said container (10; 100).

12. Mixing machine according to claim 8, characterized in that said sheets (164) are fixed by means of bonding, for example using silicone adhesive, directly to the inner surface (162) of the side wall (16; 116) of said container (10; 100).

13. Mixing machine according to claim 1, characterized in that, in a manner known per se, the bottom wall (12; 112) of said container (10; 100) is also lined with an abrasion-resistant and colourless material.

* * * * *